US011479424B2

(12) United States Patent
Araki et al.

(10) Patent No.: US 11,479,424 B2
(45) Date of Patent: Oct. 25, 2022

(54) SHEET TRANSPORT DEVICE AND NON-TRANSITORY COMPUTER READABLE MEDIUM

(71) Applicant: FUJIFILM Business Innovation Corp., Tokyo (JP)

(72) Inventors: Yuichi Araki, Kanagawa (JP); Shoichi Maeda, Kanagawa (JP); Kiyoshi Watanabe, Kanagawa (JP); Yoshiyuki Kitazawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 170 days.

(21) Appl. No.: 16/914,479

(22) Filed: Jun. 29, 2020

(65) Prior Publication Data

US 2021/0229941 A1 Jul. 29, 2021

(30) Foreign Application Priority Data

Jan. 27, 2020 (JP) ..... JP2020-011011

(51) Int. Cl.

| | |
|---|---|
| ***B65H 3/48*** | (2006.01) |
| ***B65H 7/02*** | (2006.01) |
| ***B65H 3/12*** | (2006.01) |

(52) U.S. Cl.

CPC ..... *B65H 3/48* (2013.01); *B65H 3/128* (2013.01); *B65H 7/02* (2013.01); *B65H 2406/323* (2013.01); *B65H 2801/06* (2013.01)

(58) Field of Classification Search

CPC ..... B65H 7/02; B65H 3/48; B65H 3/128

See application file for complete search history.

(56) References Cited

U.S. PATENT DOCUMENTS

| | | | | |
|---|---|---|---|---|
| 8,177,222 | B2 * | 5/2012 | Yaginuma | B65H 1/14 271/98 |
| 8,419,008 | B2 | 4/2013 | Ikeda et al. | |
| 9,254,973 | B2 * | 2/2016 | Ishida | B65H 1/14 |
| 9,359,158 | B2 * | 6/2016 | Hino | B65H 7/04 |
| 9,592,973 | B2 * | 3/2017 | Kushida | B65H 3/0684 |
| 9,650,220 | B2 * | 5/2017 | Koseki | B65H 7/14 |
| 9,926,157 | B2 * | 3/2018 | Sugawara | B65H 1/18 |

FOREIGN PATENT DOCUMENTS

| | | |
|---|---|---|
| JP | 2010-195588 | 9/2010 |

* cited by examiner

*Primary Examiner* — Howard J Sanders

(74) *Attorney, Agent, or Firm* — JCIPRNET

(57) ABSTRACT

A sheet transport device includes a processor configured to change lifting control for lifting sheets on a tray, which are to be floated up and handed over, from normal state control to small-quantity state control in a case where it is detected that the remaining number of sheets on the tray is small.

14 Claims, 12 Drawing Sheets

SHEET TRANSPORT DEVICE AND NON-TRANSITORY COMPUTER READABLE MEDIUM

CROSS-REFERENCE TO RELATED APPLICATIONS

This application is based on and claims priority under 35 USC 119 from Japanese Patent Application No. 2020-011011 filed Jan. 27, 2020.

BACKGROUND

(i) Technical Field

The present disclosure relates to a sheet transport device and a non-transitory computer readable medium.

(ii) Related Art

Japanese Unexamined Patent Application Publication No. 2010-195588 discloses a sheet feeding device. This sheet feeding device controls a lifting lowering unit to lift a tray in a case where a signal indicating that an upper surface of a topmost sheet among floated sheets is lower than a reference position for determining whether or not a sheet can be fed is output from a rear end sheet surface sensor when the topmost sheet passes the rear end sheet surface sensor, even in a case where a signal indicating that the topmost sheet is within an appropriate range is output from a sheet surface detection mechanism.

SUMMARY

Aspects of non-limiting embodiments of the present disclosure relate to providing a sheet feeding device that can make transport failure less likely to occur in a case where the remaining number of sheets is small as compared with a configuration in which the same lifting control is always performed in a case where height information of a floated sheet is not detected.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet transport device including a processor configured to change lifting control for lifting sheets on a tray, which are to be floated up and handed over, from normal state control to small-quantity state control in a case where it is detected that the remaining number of sheets on the tray is small.

DETAILED DESCRIPTION

Figure 1:
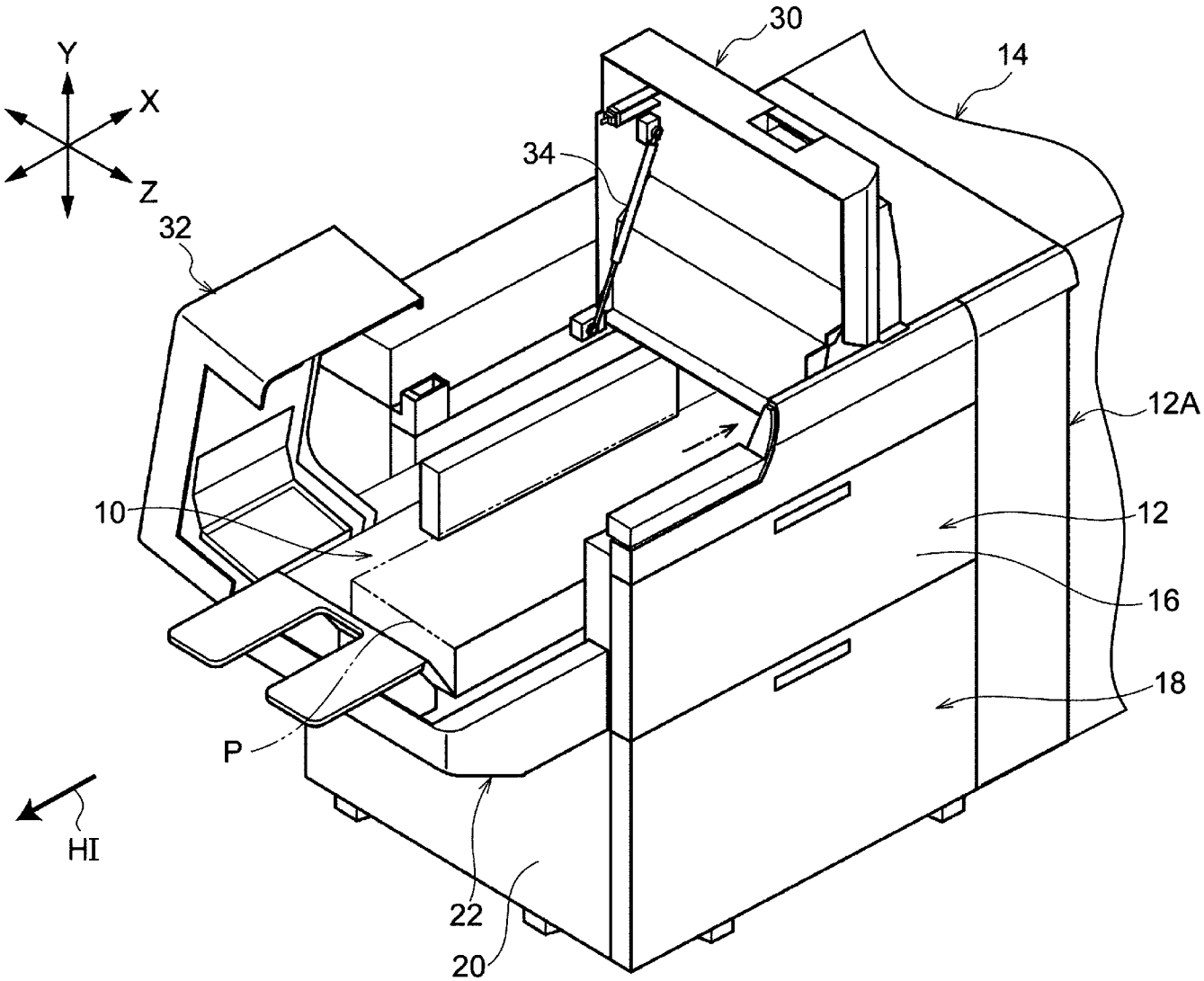
FIG. 1 is a perspective view illustrating an image forming apparatus including a sheet transport device according to a first exemplary embodiment.

An exemplary embodiment is described below with reference to the drawings.

In the following description, a direction indicated by arrow X in the drawings is a device width direction and a direction indicated by arrow Y in the drawings is a device height direction. Furthermore, a direction indicated by arrow Z that is orthogonal to the device width direction X and the device height direction Y is a device depth direction.

FIG. 1 is a perspective view illustrating an image forming apparatus 14 provided with a sheet feeding device 12 having a sheet transport device 10 according to the present exemplary embodiment. The image forming apparatus 14 is an apparatus that forms an image on a sheet P, and the image forming apparatus 14 includes an image forming unit (not illustrated) that forms an image on the sheet P and a transport unit (not illustrated) that transports the sheet P to the image forming unit.

A device body 12A of the sheet feeding device 12 has an upper containing unit 16 and a lower containing unit 18 for containing the sheets P. The upper containing unit 16 and the lower containing unit 18 can be drawn out from the device body 12A. Furthermore, an extended unit 22 that extends from a surface 20 on one side HI in the width direction is optionally attachable to the sheet transport device 10 of the sheet feeding device 12. FIG. 1 illustrates a state where the extended unit 22 has been attached to the sheet transport device 10 of the sheet feeding device 12.

The sheet P is, in other words, a medium or a film on which an image is to be formed. The sheet P is, for example, a sheet made of paper or an OHP sheet made of a PET resin. Examples of the sheet P on which an image is to be formed include a normal sheet fed from the containing unit 16 or 18 and a long sheet fed by using the extended unit 22. Plural kinds of sheets P such as sheets P having different thicknesses, sheets P having different width dimensions, and sheets P having different lengths can be used.

An upper part of the upper containing unit 16 is openable and closable by a covering part 30 supported by the device body 12A and an extension covering part 32 supported by the extended unit 22, and a damper 34 extended from the device body 12A is coupled to the covering part 30 to support the opening and closing operation.

Figure 2:
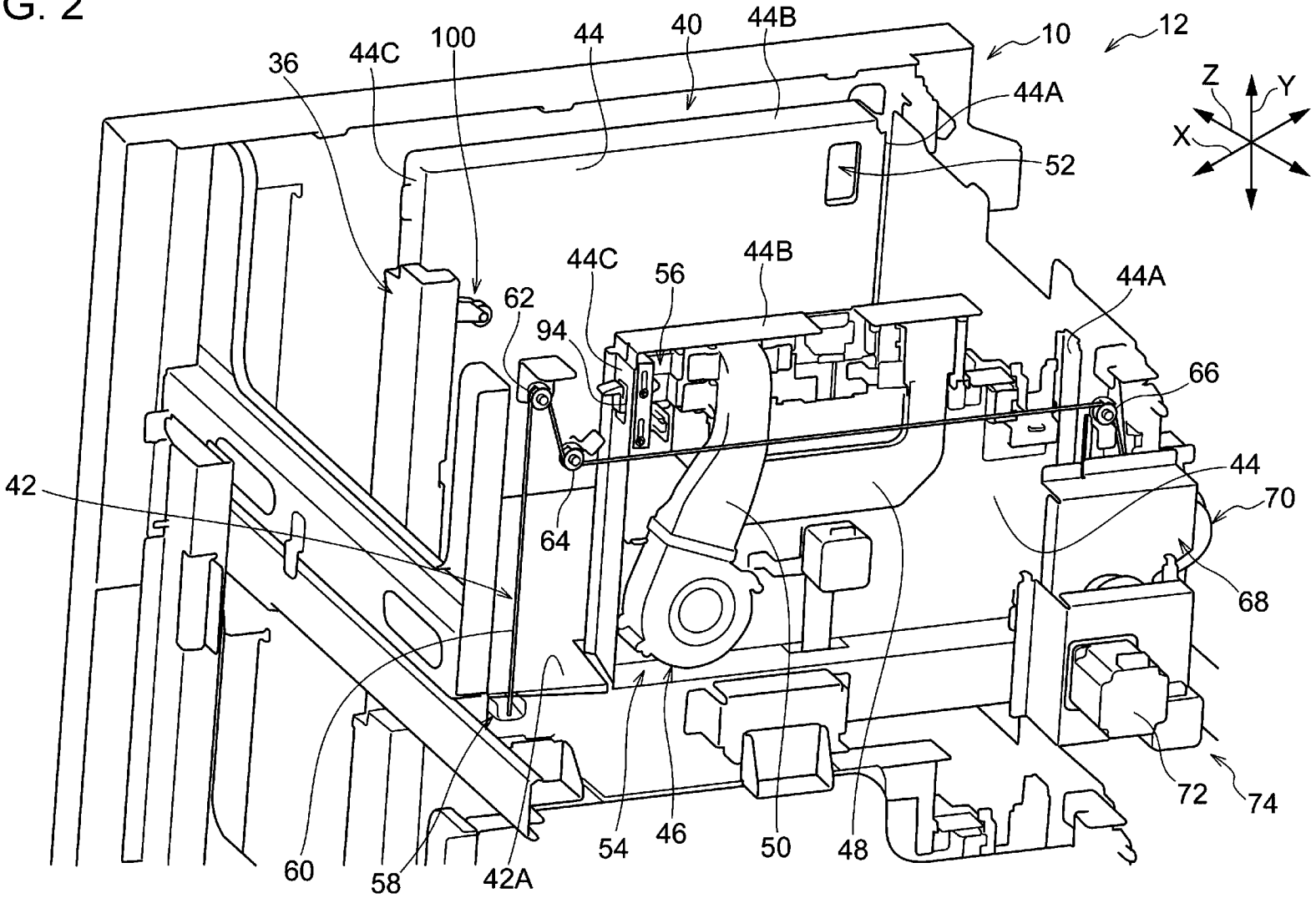
FIG. 2 is a perspective view illustrating an inside of the sheet transport device according to the exemplary embodiment.

FIG. 2 illustrates the sheet transport device 10 in the sheet feeding device 12 and illustrates a state where the extended unit 22 has been detached from the sheet transport device 10 and an end bar 36 has been raised upright. A sheet containing unit 40 in which the sheets P are contained is provided in the sheet feeding device 12 having the sheet transport device 10.

The sheet containing unit 40 has a tray 42 that constitutes a bottom plate and side walls 44 standing on respective sides of the tray 42, and a position of a rear edge of the sheet P placed on the tray 42 is determined by the end bar 36 and positions of side edges of the sheet P are determined by the side walls 44.

Side Walls

Air blowing fans 46 (only one of which is illustrated) are provided on outer surfaces of the respective side walls 44, and a first duct 48 and a second duct 50 extend from each of the air blowing fans 46. The first duct 48 is connected to an air blowing hole 52 (only an air blowing hole 52 provided in one of the side walls 44 is illustrated) that is provided in an upper part of the side wall 44 so as to be close to the image forming apparatus 14, and thus air blown from the air blowing fans 46 is blown toward the sheet P placed on the tray 42 from both sides.

The air blowing hole 52 has a vertically-long rectangular shape, and air blown through the air blowing hole 52 floats up sheets P within a desired height range on an upper side among sheets P placed on the tray 42. In this way, the air blowing fans 46, the first ducts 48, and the air blowing holes 52 of the side walls 44 constitute a floating device 54 that floats up sheets P placed on the tray 42.

A front-edge flange 44A that is bent sideways extends from a front edge of each of the side walls 44 that is close to the image forming apparatus 14, and an upper-edge flange 44B that is bent sideways extends from an upper edge of each of the side walls 44. A rear-edge flange 44C that is bent sideways extends from a rear edge of each of the side walls 44, and a small quantity detector 56 is provided on the rear-edge flange 44C of one of the side walls 44.

Tray

The tray 42 has a rectangular plate shape, and a support member 58 that extends in the width direction is provided on a lower surface of a front edge part of the tray 42 that is located close to the image forming apparatus 14 and on a lower surface of a rear edge part of the tray 42 that is located away from the image forming apparatus 14 (only one support member 58 is illustrated). An end of each of the support members 58 extends from the tray 42 (only one end is illustrated), and a front end of a wire 60 is fixed to the end.

The wire 60 extending from the support member 58 provided on the rear edge of the tray 42 is wound around a winding pulley 70 of a lifting lowering unit 68 through a first pulley 62, a second pulley 64, and a third pulley 66 provided in a housing (not illustrated). Furthermore, the wire 60 extending from the support member provided on the front edge of the tray 42 is wound around the winding pulley 70 of the lifting lowering unit 68 through the third pulley 66, and the lifting lowering unit 68 is, for example, provided with a height sensor (not illustrated) that detects a height position of the tray 42.

The winding pulley 70 is connected to a rotary shaft of the driving motor 72, for example, with a clutch interposed therebetween so that the connection is cuttable. The winding pulley 70 is rotated by the driving motor 72 to lift or lower the tray 42 suspended by the wires 60. Cutting off the connection between the driving motor 72 and the winding pulley 70 by operating the clutch enables the tray 42 suspended by the wires 60 to move down by its own weight.

In this way, the support members 58 of the tray 42, the wires 60 extending from the support members 58, the pulleys 62, 64, 66, and 70 that support the wires 60, the driving motor 72 that rotates the winding pulley 70, and the clutch constitute a lifting lowering device 74 that lifts or lowers the tray 42.

The rear edge part of the tray 42 has an extended part 42A extending sideways, and the extended part 42A moves up and down along the rear-edge flanges 44C of the side walls 44 as the tray 42 moves up and down. Furthermore, the extended part 42A turns the small quantity detector 56 on during lifting of the tray 42.

Small Quantity Detector

Figure 3:
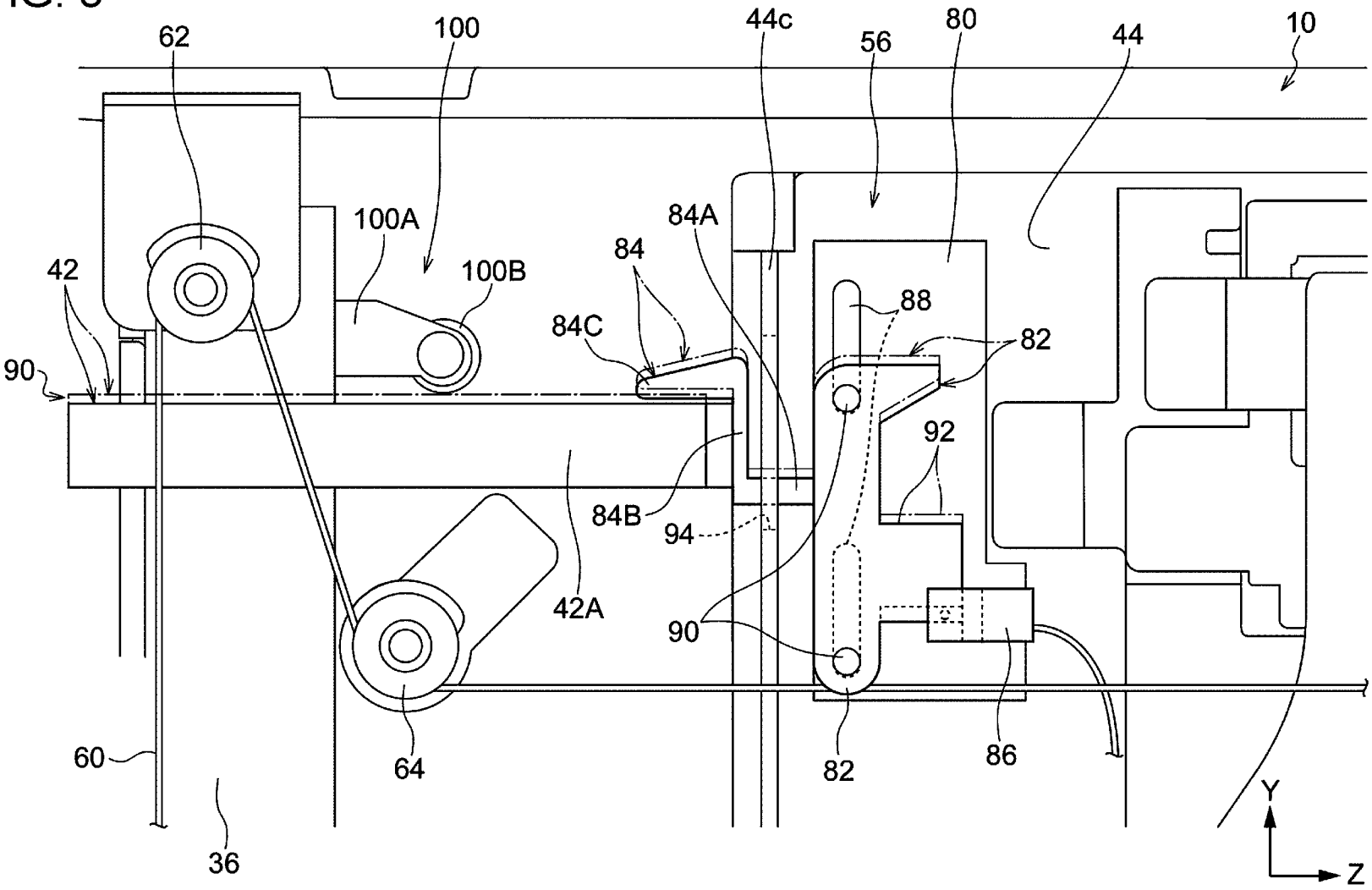
FIG. 3 is an enlarged view illustrating a substantial part of a containing unit.

As illustrated in FIG. 3, the small quantity detector 56 includes a fixed bracket 80 that is fixed to the side wall 44 and a slide bracket 82 that is supported by the fixed bracket 80 so as to be movable up and down. Furthermore, the small quantity detector 56 includes a detector 84 that is fixed to the slide bracket 82 and a small quantity sensor 86 that is provided on the fixed bracket 80.

The small quantity sensor 86 is a sensor that detects movement of the slide bracket 82, and the small quantity sensor 86 is a photosensor that is an example of the sensor. The small quantity sensor 86 has a light-emitting unit that emits light and a light-receiving unit that receives light from the light-emitting unit, and a gap is present between the light-emitting unit and the light-receiving unit.

The fixed bracket 80 has two upper and lower long holes 88 extending in an up-down direction, and a shaft 90 extending from the slide bracket 82 is inserted into each of the long holes 88 so as to be movable up and down.

The slide bracket 82 has a rectangular protruding piece 92 that protrudes toward the image forming apparatus 14. The protruding piece 92 is disposed in the gap of the small quantity sensor 86 to block a path of light from the light-emitting unit to the light-receiving unit of the small quantity sensor 86 in a normal state in which the shafts 90 extending from the slide bracket 82 are supported by lower edges of the respective long holes 88.

A base part 84A of the detector 84 is fixed to the slide bracket 82, and the base part 84A penetrates a rectangular through-hole 94 provided in the rear-edge flange 44C of the side wall 44. An upward extending piece 84B extends upward from a front end of the base part 84A, and a claw part 84C extends to a position above the extended part 42A of the tray 42 from an upper end of the upward extending piece 84B.

A lower surface of the claw part 84C is flat and makes contact with an upper surface of the tray 42 when the lifted tray 42 reaches a reference height 96 indicative of a predetermined height so that the detector 84 is lifted together with the tray 42.

When the slide bracket 82 moves up as a result of lifting of the detector 84, the protruding piece 92 of the slide bracket 82 is deviated from the light path of the small quantity sensor 86. This allows light to pass from the light-emitting unit to the light-receiving unit of the small quantity sensor 86. As a result, the light-receiving unit that has received the light from the light-emitting unit turns on and outputs a signal indicating that the tray 42, which moves up as the remaining number of sheets on the tray 42 decreases, has reached the reference height 96 and the remaining number of sheets is small.

End Bar

The end bar 36 is disposed on a rear edge side of the tray 42, and a sheet height detector 100 is provided on an upper end part of the end bar 36.

Sheet Height Detector

The sheet height detector 100 includes an arm unit 100A whose base end part is rotatably supported by the end bar 36 and a roller 100B that is rotatably supported by a front end part of the arm unit 100A. Furthermore, the sheet height detector 100 includes a sheet height switch (not illustrated) that turns on upon detection of inclination of the arm unit 100A about the base end part. The roller 100B is configured to make contact with a topmost sheet P placed on the tray 42 and is rotatable in a direction in which the sheet P is fed.

When the roller 100B makes contact with the sheet P on the tray 42 and a front end of the arm unit 100A is inclined upward, the sheet height switch turns on, and the sheet height detector 100 outputs a signal indicating that and a height position of the topmost sheet P on the tray 42 has reached a height suitable for feeding. Meanwhile, when the sheet P is separated from the roller 100B and the front end of the arm unit 100A is inclined downward, the sheet height switch turns off, and the sheet height detector 100 outputs a signal indicating that the height position of the topmost sheet P on the tray 42 has become lower than the height suitable for feeding.

Transport Device

Figure 4:
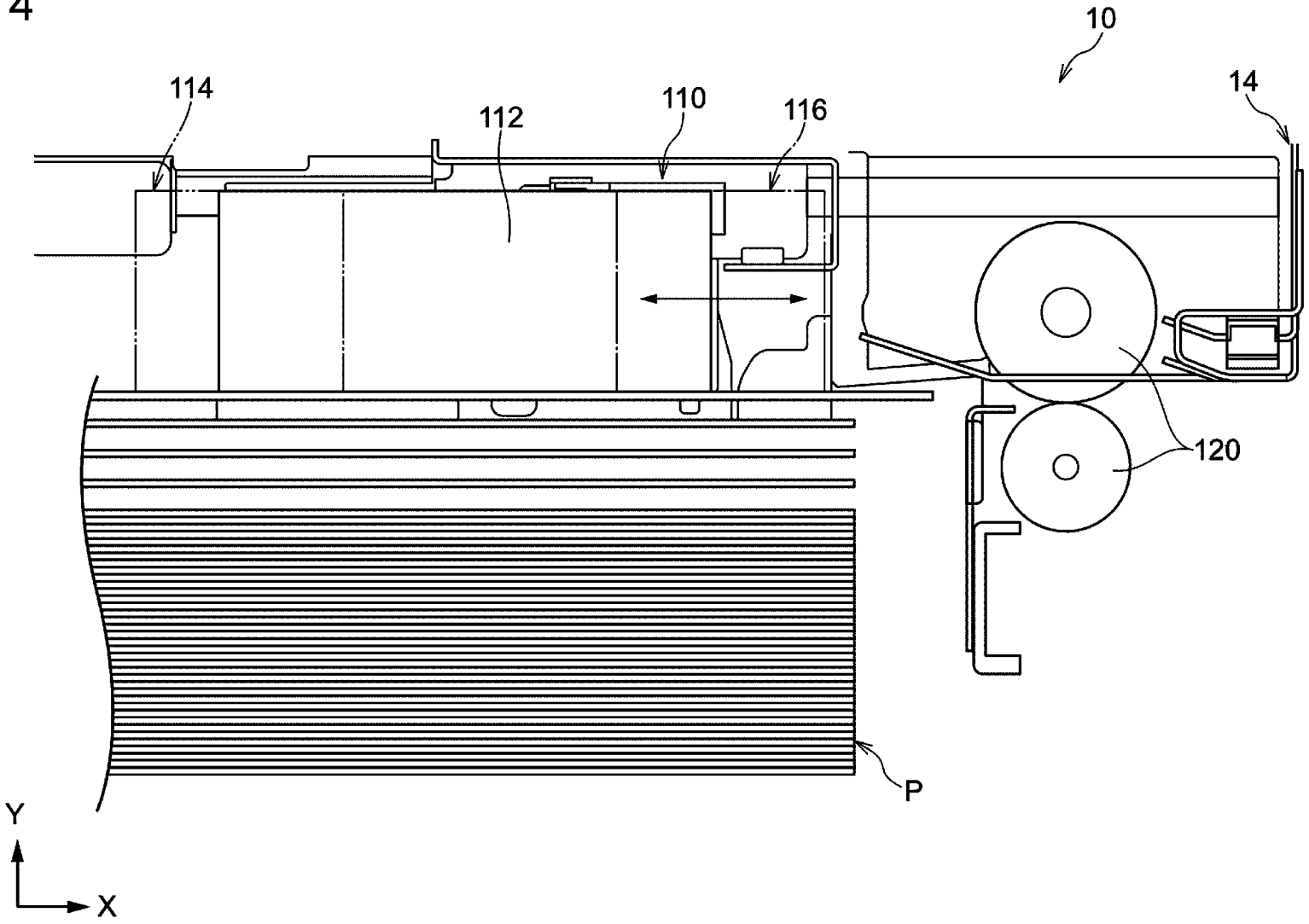
FIG. 4 is an explanatory view illustrating how a sheet in the containing unit is transported.

As illustrated in FIG. 4, a transport device 110 that sucks and transports a floated sheet P is provided above the tray 42 so as to be located close to the image forming apparatus 14.

This transport device 110 includes a suction head 112 that sucks a floated sheet P and a moving mechanism (not illustrated) that moves the suction head 112 in the device width direction X.

Figure 5:
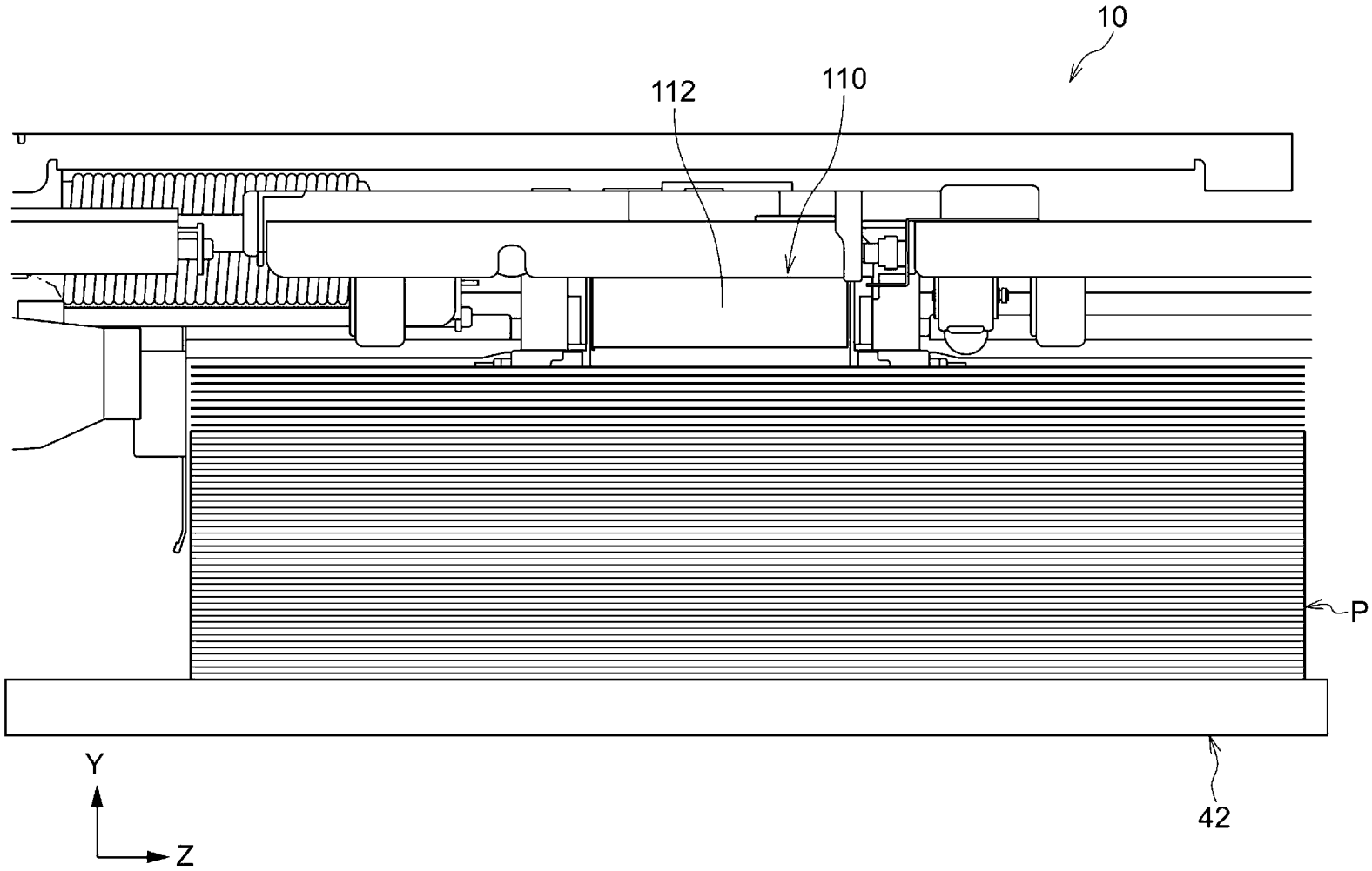
FIG. 5 is an explanatory view illustrating a state where the remaining number of sheets in the containing unit is large.
Figure 6:
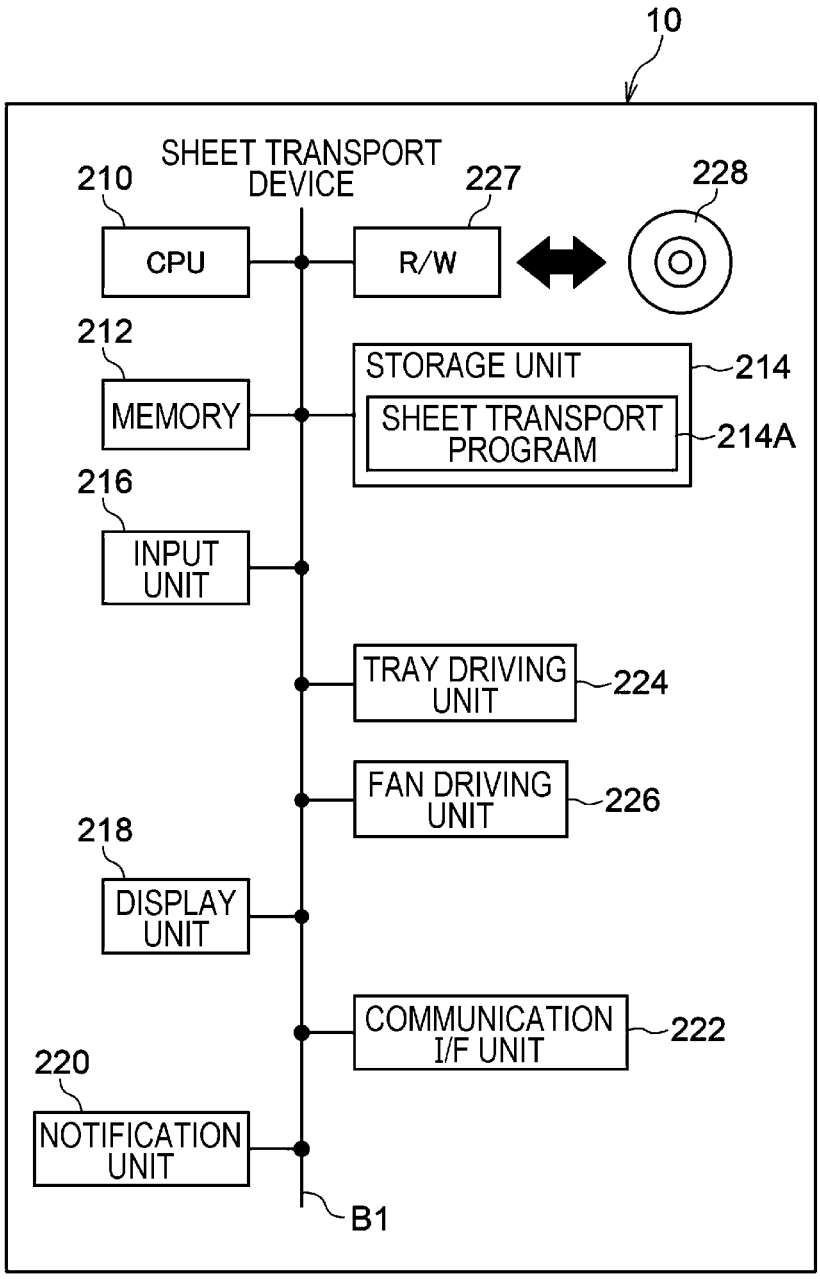
FIG. 6 is a block diagram illustrating an example of a hardware configuration of the sheet transport device according to the exemplary embodiment.

As illustrated in FIG. 5, the suction head 112 is disposed in a central part, in the width direction, of the tray 42 for the sheets P.

This suction head 112 has a negative-pressure chamber to which a negative pressure is supplied from a negative-pressure device (not illustrated) and has, in a lower surface thereof, plural suction holes communicated with the negative-pressure chamber. This allows the suction head 112 to suck and hold a floated sheet P with use of the negative pressure from the suction holes.

As illustrated in FIG. 4, the moving mechanism moves the suction head 112 between a suction position 114 and a handover position 116.

The suction position 114 is set so that a central part, in a length direction, of the suction head 112 is located at a center, in a width direction, of the air blowing hole 52 (see FIG. 2). This makes it easy to suck a sheet P floated by the floating device 54 (see FIG. 2).

The handover position 116 is a position at which a sheet P sucked at the suction position 114 is handed over to the image forming apparatus 14 side. At this handover position 116, a front end of the transported sheet P is inserted between upper and lower handover rolls 120 provided in the image forming apparatus 14, and the sheet P is thus handed over to the image forming apparatus 14.

Hardware Configuration of Sheet Transport Device

The sheet transport device 10 includes a central processing unit (CPU) 210, which is a controller and a processor, a memory 212 such as a RAM that serves as a temporary storage region, a storage unit 214 such as a non-volatile ROM, an input unit 216, and a display unit 218 such as a liquid crystal display. Furthermore, the sheet transport device 10 includes a notification unit 220 such as a speaker, a communication interface (I/F) unit 222 for communication with an external device or the like, a tray driving unit 224 including the lifting lowering device 74, and a fan driving unit 226 that drives the air blowing fan 46 of the floating device 54. The sheet transport device 10 includes a medium reading writing device (R/W) 227 as an example of a device for program input.

The CPU 210, the memory 212, the storage unit 214, the input unit 216, the display unit 218, the notification unit 220, the communication I/F unit 222, the tray driving unit 224, the fan driving unit 226, and the medium reading writing device 227 are connected to one another through a bus Bl. The medium reading writing device 227 reads out information from a storage medium 228 and writes information into the storage medium 228.

The input unit 216 is connected to members such as the small quantity sensor 86 of the small quantity detector 56, the sheet height switch (not illustrated) of the sheet height detector 100, an operation panel of the sheet transport device 10, and the height sensor (not illustrated) that detects a height position of the tray. The input unit 216 supplies states of the small quantity sensor 86 and the sheet height switch and information entered on the operation panel to the CPU 210.

The operation panel receives sheet size information indicative of a size of sheets P placed on the tray 42, information on a basis weight of the sheets P, and information on ON/OFF of small quantity control, and these pieces of information are stored in the RAM.

The basis weight is a weight per unit area of a sheet P, and a thickness dimension of the sheet P can be determined from the basis weight.

The storage unit 214 is, for example, a hard disk drive (HDD), a solid state drive (SSD), or a flash memory. The storage medium 228 serving as a storage unit stores therein a sheet transport program 214A for causing the sheet transport device 10 to operate.

The sheet transport program 214A is read out from the storage medium 228 set in the medium reading writing device 227 and is then stored in the storage unit 214. The sheet transport program 214A may be downloaded over a network.

The CPU 210 reads out the sheet transport program 214A from the storage unit 214, loads the sheet transport program 214A into the memory 212, and sequentially executes processes of the sheet transport program 214A. In this way, the CPU 210 serves as a processor and a controller. The CPU 210 operates in accordance with the sheet transport program 214A, thereby causing the sheet transport device 10 to operate.

Operation

Next, operation of the sheet transport device according to the present exemplary embodiment is described with reference to FIGS. 7 through 15.

Lifting Processing

Figure 7:
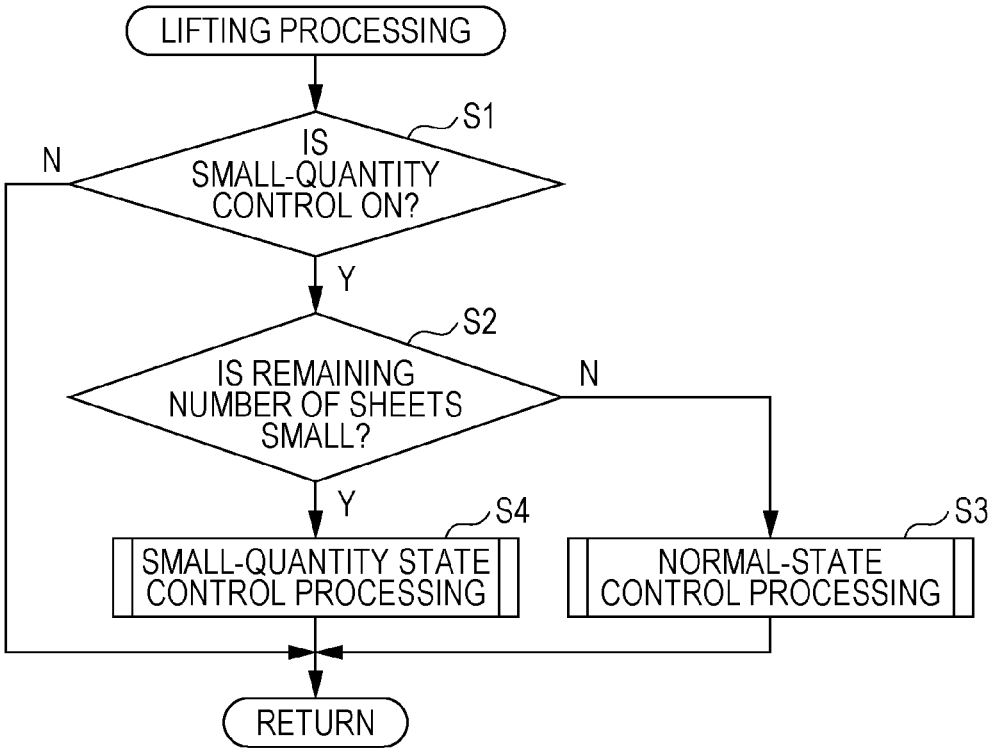
FIG. 7 is a flowchart illustrating an example of lifting processing according to the exemplary embodiment.

When the CPU 210 of the sheet transport device executes the sheet transport program 214A and lifting processing is called up during transport control processing, it is determined whether or not small quantity control has been turned on, for example, by input on the operation panel of the sheet transport device 10 as illustrated in FIG. 7 (S1).

In a case where the small quantity control is off in step S1, the processing returns to the routine that called up the lifting processing since a user has chosen not to execute the small quantity control.

In a case where the small quantity control is on in step S1, it is determined from the input unit 216 whether or not the small quantity sensor 86 of the small quantity detector 56 is on since the user has chosen to execute the small number control (S2).

In a case where the small quantity sensor 86 is not on in step S2 and the remaining number of sheets P on the tray 42 to be floated up and handed over is larger than a predetermined value, lifting control for lifting the sheets P is performed according to normal control processing (S3), and the processing returns to the routine that called up the lifting processing.

Meanwhile, in a case where the tray 42 has been lifted in accordance with a decrease in the remaining number of sheets on the tray 42 and the small quantity sensor 86 is on in step S2, small-quantity state control processing is executed since the remaining number of sheets P on the tray 42 to be floated up and handed over is small (S4), and then the processing returns to the routine that called up the lifting processing.

Small-Quantity State Control Processing

Figure 8:
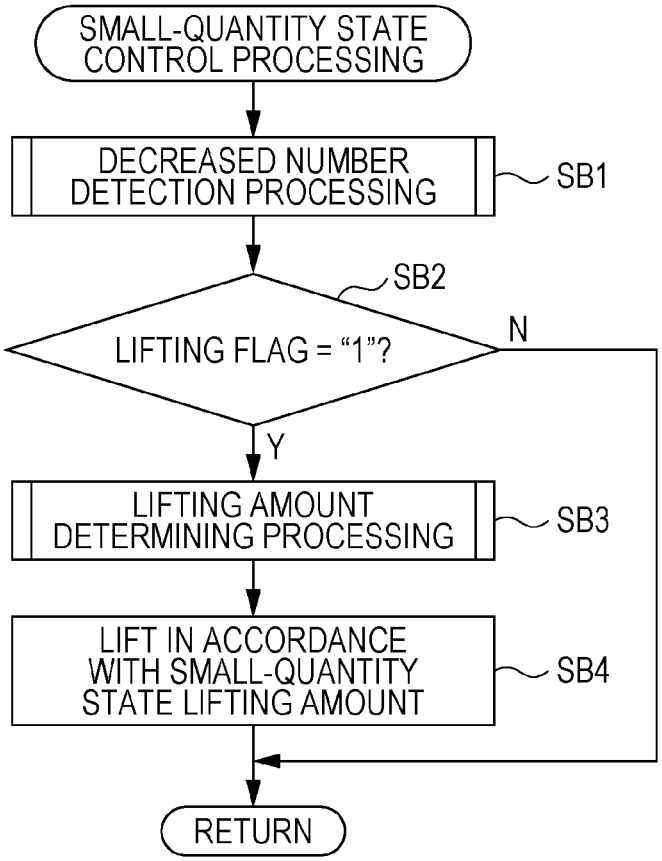
FIG. 8 is a flowchart illustrating an example of small-quantity state control processing according to the exemplary embodiment.

In the small-quantity state control processing, decreased number detection processing is executed as illustrated in FIG. 8 (SB1).

Decreased Number Detection Processing (1)

Figure 9:
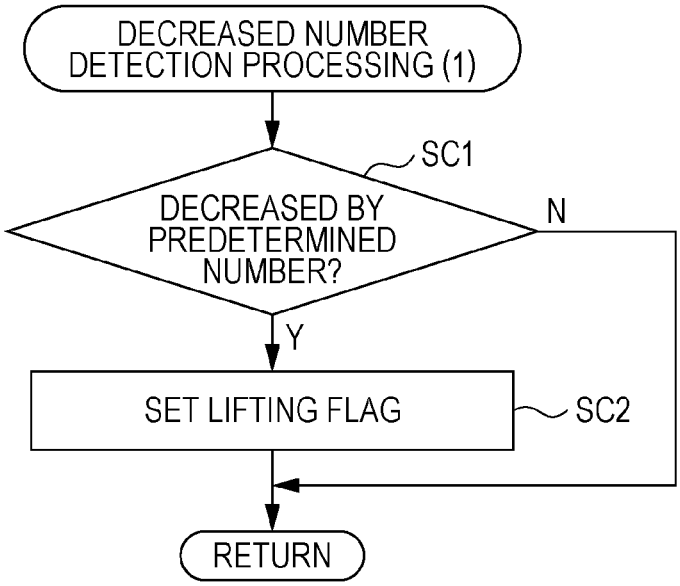
FIG. 9 is a flowchart illustrating an example of decreased number detection processing (1) according to the exemplary embodiment.

This decreased number detection processing is, for example, decreased number detection processing (1) as illustrated in FIG. 9. In the decreased number detection processing (1), it is determined whether or not the remaining number of sheets P on the tray 42 has decreased by a predetermined number (SC1).

Whether or not the remaining number of sheets P on the tray 42 has decreased by the predetermined number is determined, for example, by using a signal from the sheet height detector 100 that detects that a height position of a topmost sheet P on the tray 42 has become lower than a height suitable for feeding.

That is, a method for determining whether or not the remaining number of sheets P on the tray 42 has decreased by the predetermined number is different from a method for determining whether or not the remaining number of sheets P is small by the small quantity sensor 86.

In a case where the remaining number of sheets P has decreased by the predetermined number in step SC1, a lifting flag preset in the RAM is set to "1", and the processing returns to the small-quantity state control processing that called up the decreased number detection processing (1). Meanwhile, in a case where the remaining number of sheets P has not decreased by the predetermined number in step SC1, the processing returns to the small-quantity state control processing that called up the small-quantity state control processing while keeping the lifting flag "0".

The lifting flag is a flag for determining whether or not to lift the tray 42. In a case where the lifting flag is "1", the tray 42 is lifted in the small-quantity state control processing. Meanwhile, in a case where the lifting flag is "0", the tray 42 is not lifted in the small-quantity state control processing.

Decreased Number Detection Processing (2)

Figure 10:
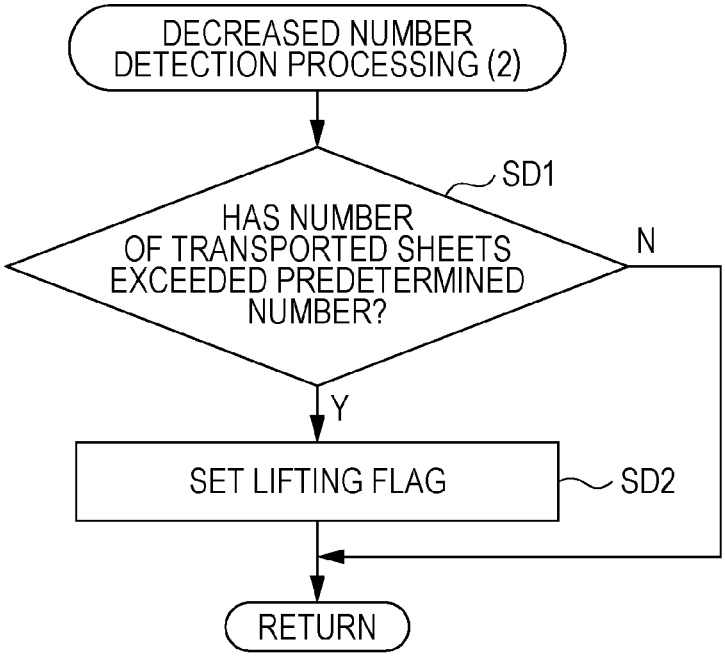
FIG. 10 is a flowchart illustrating an example of decreased number detection processing (2) according to the exemplary embodiment.

FIG. 10 illustrates decreased number detection processing (2) that is another example of the decreased number detection processing. In this decreased number detection processing (2), it is detected that the remaining number of sheets P has decreased by a predetermined number on the basis of the number of sheets P transported from the tray 42 after change to the small-quantity state control. That is, a method for determining whether or not the remaining number of sheets P has decreased by the predetermined number is different from the method for determining whether or not the remaining number of sheets P is small by the small quantity sensor 86.

The number of sheets P used for this detection varies depending on the thickness of the sheets P, and the number of sheets P used for this detection becomes larger as the thickness of the sheets P becomes thinner. That is, in the decreased number detection processing (2), it is determined whether or not the number of sheets P transported from the tray 42 after change to the small-quantity state control has exceeded a predetermined number calculated from the basis weight information stored in the RAM (SD1).

In calculation of the predetermined number, a thickness dimension of the sheets P is calculated from the basis weight information, and the predetermined number is set small in a case where the sheets P are thick. Meanwhile, the predetermined number is set large in a case where the sheets P are thin. It is determined whether or not the predetermined number of sheets P thus calculated based on the thickness dimension of the sheets P have been transported from the tray 42.

In a case where it is determined in step SD1 that the number of sheets P transported from the tray 42 after change to the small-quantity state control has exceeded the predetermined number, the lifting flag preset in the RAM is set to "1", and the processing returns to the small number control processing that called up the decreased number detection processing (2). Meanwhile, in a case where it is determined in step SD1 that the number of sheets P transported from the tray 42 after change to the small-quantity state control has not exceeded the predetermined number, the processing returns to the small-quantity state control processing that called up the small-quantity state control processing while keeping the lifting flag "0".

Small-Quantity State Control Processing

In the small-quantity state control processing, it is determined whether or not the lifting flag is "1" (SB2).

In a case where the lifting flag is "0" in step SB2, the processing returns to the routine that called up the small-quantity state control processing. Meanwhile, in a case where the lifting flag is "1" in step SB2, lifting amount determining processing is executed (SB3).

Lifting Amount Determining Processing

Figure 11:
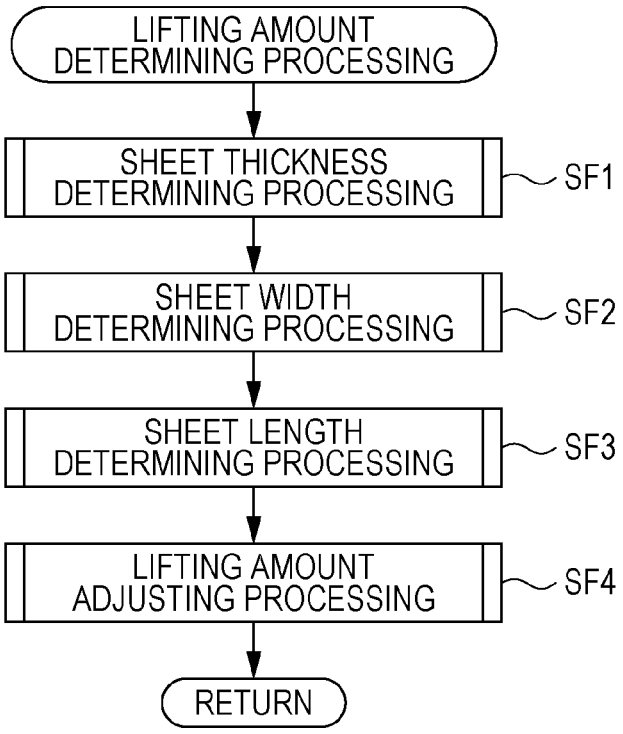
FIG. 11 is a flowchart illustrating an example of lifting amount determining processing according to the exemplary embodiment.

In the lifting amount determining processing, sheet thickness determining processing (SF1), sheet width determining processing (SF2), sheet length determining processing (SF3), and lifting amount adjusting processing (SF4) are sequentially executed, and then the processing returns to the small-quantity state control processing that called up the lifting amount determining processing, as illustrated in FIG. 11.

Sheet Thickness Determining Processing

Figure 12:
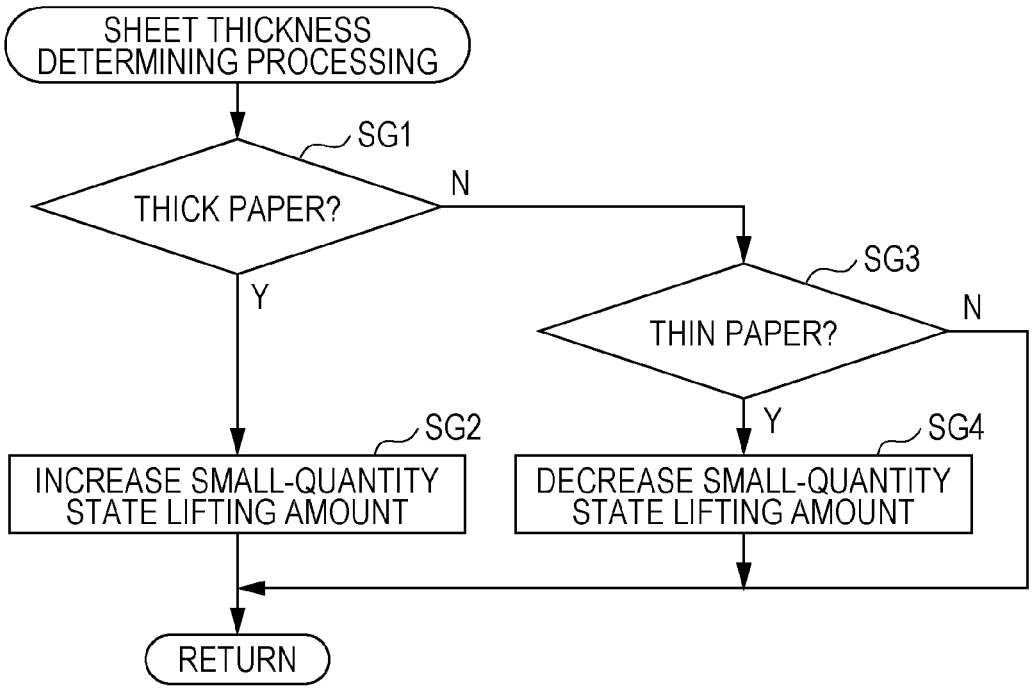
FIG. 12 is a flowchart illustrating an example of sheet thickness determining processing according to the exemplary embodiment.

In the sheet thickness determining processing, it is determined whether or not the sheets P are thick paper, for example, by comparing the basis weight information stored in the RAM with a predetermined thick paper threshold value (SG1) as illustrated in FIG. 12.

In a case where it is determined in step SG1 that the sheets P are thick paper, a small-quantity state lifting amount preset in the RAM is increased by a preset amount (SG2), and the processing returns to the lifting amount determining processing, and then the sheet width determining processing is executed (SF2).

This small-quantity state lifting amount is a lifting amount of the tray 42 for lifting the sheets P in a case where the remaining number of sheets P has decreased by the predetermined number in the small-quantity state control, and a predetermined small-quantity state reference amount is set as the small-quantity state lifting amount.

In a case where it is determined in step SG1 that the sheets P are not thick paper, it is determined whether or not the sheets p are thin paper, for example, by comparing the basis weight information stored in the RAM with a predetermined thin paper threshold value (SG3).

In a case where it is determined in step SG3 that the sheets P are not thin paper, the processing returns to the lifting amount determining processing, and then the sheet width determining processing is executed (SF2). Meanwhile, in a case where it is determined in step SG3 that the sheets P are thin paper, the small-quantity state lifting amount preset in the RAM is decreased by a preset amount (SG4), and the processing returns to the lifting amount determining processing, and then the sheet width determining processing is executed (SF2).

As a result, during the small-quantity state control, the lifting amount of the tray is made larger in a case where the thickness of the sheets is thick than in a case where the thickness of the sheets is thin.

Sheet Width Determining Processing

Figure 13:
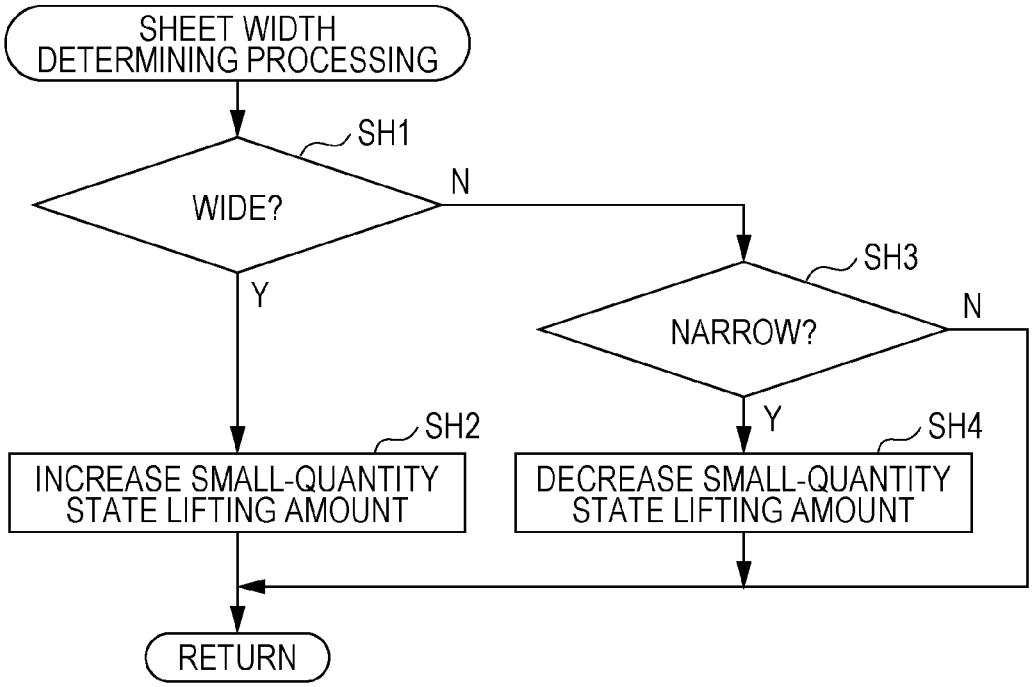
FIG. 13 is a flowchart illustrating an example of sheet width determining processing according to the exemplary embodiment.

When the sheet width determining processing (SF2) is called up from the lifting amount determining processing, it is determined whether or not the sheets P are wide, for example, by comparing sheet size information stored in the RAM with a predetermined reference width threshold value (SH1) as illustrated in FIG. 13.

In a case where it is determined in step SH1 that the width of the sheets P is larger than the reference threshold value, that is, the sheets P are wide, the small-quantity state lifting amount preset in the RAM is increased by a preset amount (SH2), and the processing returns to the lifting amount determining processing, and then the sheet length determining processing is executed (SF3).

In a case where it is determined in step SH1 that the width of the sheets P is equal to or smaller than the reference threshold value, that is, the sheets P are not wide, it is determined whether or not the sheets P are narrow, for example, by comparing the sheet size information stored in the RAM with a predetermined reference width threshold value (SH3).

In a case where it is determined in step SH3 that the sheets P are not narrow, the processing returns to the lifting amount determining processing, and then the sheet length determining processing is executed (SF3). Meanwhile, in a case where it is determined in step SH3 that the sheets P are narrow, the small-quantity state lifting amount preset in the RAM is decreased by a preset amount (SH4), and the processing returns to the lifting amount determining processing, and then the sheet length determining processing is executed (SF3).

As a result, during the small-quantity state control, the lifting amount of the tray 42 is made larger in a case where the width dimension of the sheet P is large than in a case where the width dimension of the sheet P is small.

Sheet Length Determining Processing

Figure 14:
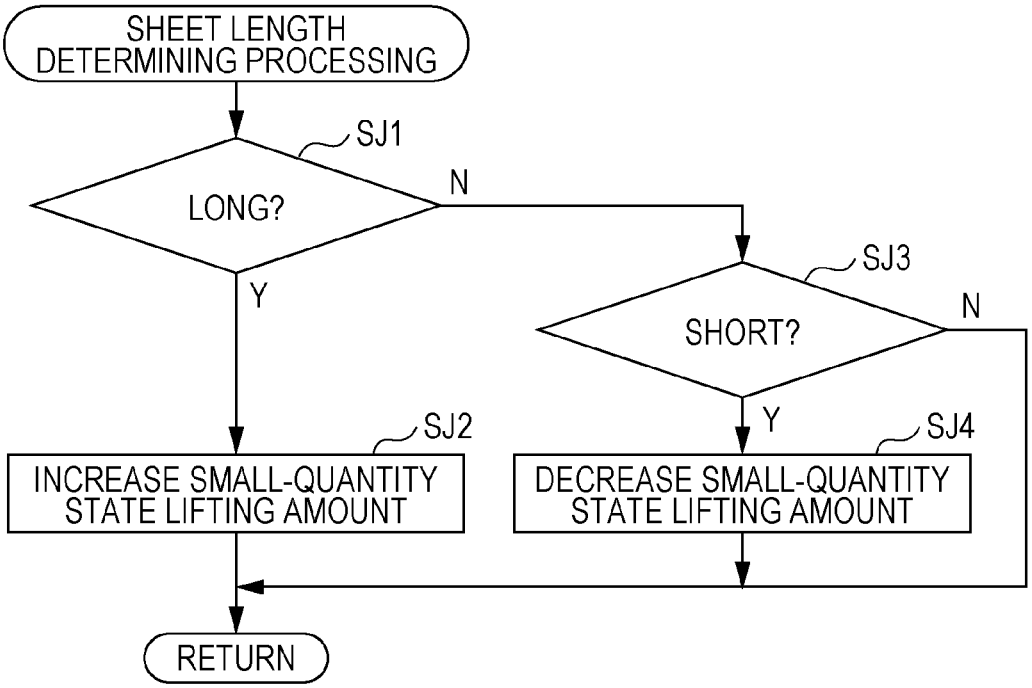
FIG. 14 is a flowchart illustrating an example of sheet length determining processing according to the exemplary embodiment.

When the sheet length determining processing (SF3) is called up from the lifting amount determining processing, it is determined whether or not the sheets P are long, for example, by comparing the sheet size information stored in the RAM with a predetermined reference length threshold value (SJ1) as illustrated in FIG. 14.

In a case where it is determined in step SJ1 that the length of the sheets P is larger than the reference length threshold value, that is, the sheets P are long, the small-quantity state lifting amount preset in the RAM is increased by a preset amount (SJ2), and the processing returns to the lifting amount determining processing, and then the lifting amount adjusting processing is executed (SF4).

In a case where it is determined in step SJ1 that the length of the sheets P is equal or smaller than the reference length threshold value, that is, the sheets P are not long, it is determined whether or not the sheets P are short, for example, by comparing the sheet size information stored in the RAM with a predetermined reference length threshold value (SJ3).

In a case where it is determined in step SJ3 that the sheets P are not short, the processing returns to the lifting amount determining processing. Meanwhile, in a case where it is determined in step SJ3 that the sheets P are short, the small-quantity state lifting amount preset in the RAM is decreased by a preset amount (SJ4), and the processing returns to the lifting amount determining processing.

As a result, during the small-quantity state control, the lifting amount of the tray 42 is made larger in a case where the length dimension of the sheet P is large than in a case where the length dimension of the sheet P is small.

The small-quantity state reference amount preset as the small-quantity state lifting amount in the RAM is set larger than a lifting amount during the normal state control. Also during the normal state control, the lifting amount is increased or decreased in accordance with a sheet thickness, a sheet width, and a sheet length, and an amount of the increase or the decrease is, for example, the same as that during the small-quantity state control.

Accordingly, in the lifting amount determining processing, a value set as the small-quantity state lifting amount after execution of the sheet thickness determining processing (SF1), the sheet width determining processing (SF2), and the sheet length determining processing (SF3) becomes larger than the lifting amount during the normal state control.

As a result, during the small-quantity state control, the sheet P can be lifted by the small-quantity state lifting amount larger than the lifting amount during the normal state control.

Lifting Amount Adjusting Processing

Figure 15:
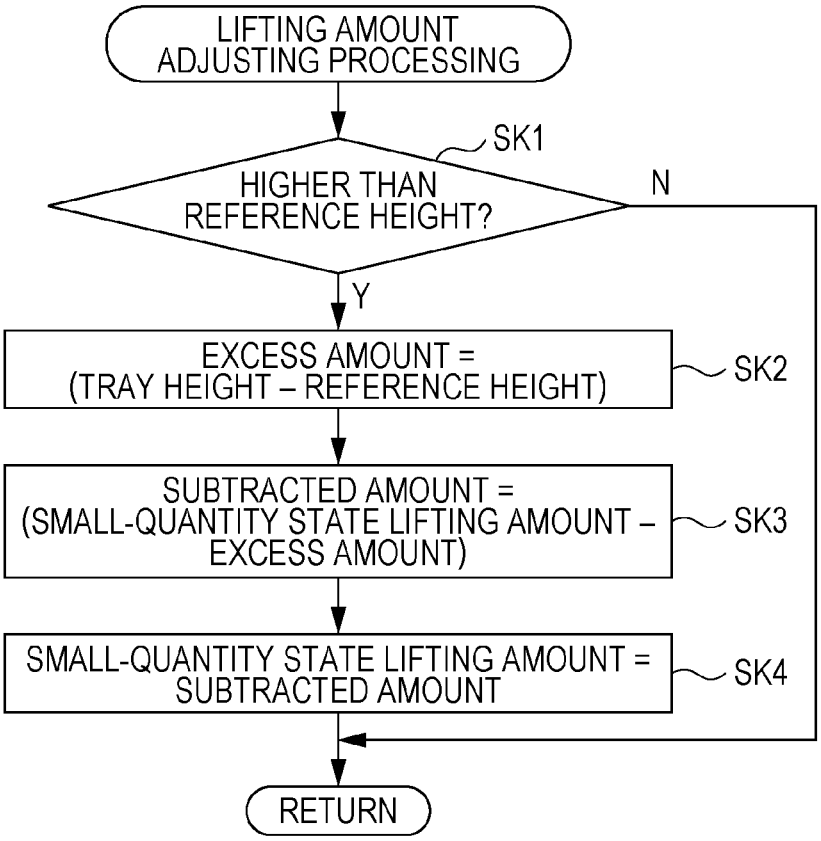
FIG. 15 is a flowchart illustrating an example of lifting amount adjusting processing according to the exemplary embodiment.

In the lifting amount determining processing, the lifting amount adjusting processing (SF4) is called up, and the lifting amount adjusting processing is executed as illustrated in FIG. 15.

The lifting amount adjusting processing is processing for lifting the tray 42 in a case where the tray 42 has been already lifted to a position higher than the reference height 96 for detecting that the number of sheets P is small before start of transport of the sheets P from the tray 42.

In this lifting amount adjusting processing, it is determined whether or not the tray 42 is at a position higher than the reference height 96, for example, by comparing the height of the tray 42 with a predetermined height threshold value stored in the ROM (SK1).

The height threshold value stored in the ROM is set to a value indicative of a position higher by a predetermined amount than the reference height 96 at which the sheet height detector 100 turns on. As a result, the lifting amount adjusting processing is not executed unless the tray 42 is at a position higher by the predetermined amount than the reference height 96 even in a case where the tray 42 is at a position higher than the reference height 96 at which the sheet height detector 100 turns on.

In a case where it is determined in step SK1 that the tray 42 is not at a position higher than a height position indicated by the height threshold value, the processing returns to the lifting amount determining processing and then returns to the small-quantity state control processing, and the tray 42 is lifted by the lifting amount set as the small-quantity state lifting amount (SB4). Then, the processing returns to the lifting processing.

As a result, the sheets P on the tray 42 are lifted by the lifting amount set on the basis of the sheet thickness, the sheet width, and the sheet length.

Meanwhile, in a case where it is determined in step SK1 that the tray 42 is at a position higher than the height position indicated by the height threshold value, the reference height 96 is subtracted from a current height of the tray 42 to obtain an excess amount (SK2). Next, the excess amount is subtracted from the small-quantity state lifting amount determined in the sheet thickness determining processing, the sheet width determining processing, and the sheet length determining processing to obtain a subtracted value (SK3).

Then, this subtracted value is set as the small-quantity state lifting amount (SK4), the processing returns to the lifting amount determining processing and then returns to the small-quantity control processing, and the tray 42 is lifted in accordance with the lifting amount set as the small-quantity state lifting amount (SB4). Then, the processing returns to the lifting processing.

As a result, in a case where the tray 42 has been already lifted to a position higher by the excess amount than the reference height 96, the tray 42 is lifted by an amount obtained by subtracting the excess amount from the small-quantity state lifting amount when the tray 42 is lifted by the small-quantity state lifting amount larger than the lifting amount during the normal state control.

Although a case where the sheets P on the tray 42 are lifted by lifting the tray 42 during the small-quantity state control has been described in the present exemplary embodiment, this configuration is not restrictive. For example, during the small-quantity state control, the sheets P may be lifted by increasing output of the air blowing fan 46 for floating up the sheets P and thus controlling an air blow amount.

Effects

Effects of the present exemplary embodiment related to the above configuration are described below.

In the present exemplary embodiment, lifting control for lifting the sheets P is changed from normal state control to small-quantity state control in a case where it is detected that the remaining number of sheets P on the tray 42 to be floated up and handed over is small.

This makes it possible to perform control corresponding to the case where the remaining number of sheets is small, as compared with a configuration in which the same lifting control is always performed in a case where height information of floated sheets P is not detected. This can make transfer failure less likely to occur.

Furthermore, it is possible to perform control corresponding to the case where the remaining number of sheets is small, as compared with a case where the tray 42 is lifted only on the basis of height information of floated sheets P.

Furthermore, the sheets P are lifted by a small-quantity state lifting amount, which is larger than a lifting amount during the normal state control, in a case where it is detected that the remaining number of sheets P has decreased by a predetermined number during the small-quantity state control.

This can make failure to hand over a sheet P less likely to occur, as compared with a case where the lifting amount of the sheets P is not changed even in a case where the remaining number of sheets P is small.

Specifically, as the remaining number of sheets P on the tray 42 becomes smaller and a floating height of a topmost sheet P becomes lower, a distance between the suction surface of the suction head 112 and the sheet P becomes larger. As a result, suction of the sheet P takes time, and misfeeding can occur.

Furthermore, in a case where the sheet P is thin, both ends of the sheet P can sag down. In this case, unexpected collision can occur on a transport path on a downstream side. This may undesirably damage the sheet P or cause misfeeding.

Meanwhile, in the present exemplary embodiment, the sheets P are lifted by a small-quantity state lifting amount, which is larger than a lifting amount during the normal state control, in a case where it is detected that the remaining amount of sheets P has decreased by a predetermined number during the small-quantity state control. As a result, failure that can occur at a time of handover of a sheet P becomes less likely to occur.

Furthermore, a method for determining whether the remaining number of sheets P is small and a method for determining whether the remaining number of sheets P has decreased by a predetermined number are different.

Accordingly, accuracy of detection of the remaining number of sheets P before the change to the small-quantity state control and accuracy of detection of the remaining number of sheets P after the change to the small-quantity state control can be made different, as compared with a case where the tray 42 is lifted only on the basis of height information of a floated sheet P.

In addition, in the decreased number detection processing (2), it is detected that the remaining number of sheets P has decreased by a predetermined number on the basis of the number of sheets P transported from the tray 42 after change to the small-quantity state control.

This makes it possible to perform detection corresponding to the remaining number of sheets P as compared with a case where the remaining number of sheets P is detected on the basis of a lifting amount of the tray 42.

The number of sheets P used for detection is larger in a case where the sheets P are thin than in a case where the sheets P are thick.

This makes it possible to perform detection corresponding to the height of sheets P as compared with a case where detection is always performed on the basis of a constant number of sheets P.

Furthermore, in the decreased number detection processing (1), it is detected that the remaining number of sheets P has decreased by a predetermined number on the basis of a lifting amount of the tray 42 lifted in accordance with the height of sheets P on the tray 42 during the small-quantity state control.

This can simplify control as compared with a case where the remaining number of sheets P is detected on the basis of the number of transported sheets P.

In addition, the sheets P may be lifted by controlling an air blow amount for floating up the sheets P during the small-quantity state control. This can simplify a mechanism for lifting up sheets as compared with a case where the tray 42 is lifted.

The sheets P are lifted by controlling the lifting amount of the tray 42 during the small-quantity state control.

This makes it possible to easily adjust the height of the sheets P as compared with a case where an air blow amount for floating up the sheets P is controlled.

Furthermore, during the small-quantity state control, the lifting amount of the tray 42 is made larger in a case where the sheets P are thick than in a case where the sheets P are thin.

This makes it possible to lift the tray 42 in accordance with a sheet thickness as compared with a case where the lifting amount is always constant.

In addition, during the small-quantity state control, the lifting amount of the tray 42 is made larger in a case where a width dimension of the sheets P is large than in a case where the width dimension of the sheets P is small.

This can lift the tray 42 in accordance with a sheet width as compared with a case where the lifting amount is always constant irrespective of the sheet width.

Furthermore, during the small-quantity state control, the lifting amount of the tray 42 is made larger in a case where a length dimension of the sheets P is large than in a case where the length dimension of the sheets P is small.

This can lift the tray 42 in accordance with a sheet length as compared with a case where the lifting amount is always constant irrespective of the sheet length.

Furthermore, the tray 42 is lifted by a subtracted amount obtained by subtracting an excess amount from a small-quantity state lifting amount when the tray 42 is lifted by the small-quantity state lifting amount, which is larger than the lifting amount during the normal state control, in a case where the tray 42 has been already lifted to a position higher by the excess amount than a reference height for detecting that the number of sheets is small.

This can lift the tray 42 according to a case where the number of sheets fed to the tray 42 is small as compared with a case where the lifting amount during the small-quantity state control is constant.

Specifically, excess lifting of the tray 42 can be prevented in a case where the tray 42 has been already lifted to a position higher than the reference height 96.

Although it is detected that the remaining number of sheets is small on the basis of an operation state of the small quantity sensor 86 of the small quantity detector 56 in the present exemplary embodiment, this configuration is not restrictive.

For example, it may be detected that the remaining number of sheets is small on the basis of a lifting drive time from a state where the tray 42 has been lowered to a bottom dead center or the number of drive pulses of the driving motor 72. Furthermore, information indicating that the remaining number of sheets is small may be displayed on a display panel.

Note that the sheet transport device 10 can be called a paper feeding device or a tray lifting lowering device. This paper feeding device or tray lifting lowering device includes the lifting lowering device 74, the floating device 54, the suction head 112, and the transport device 110.

In the embodiment above, the term "processor" refers to hardware in a broad sense. Examples of the processor includes general processors (e.g., CPU: Central Processing Unit), dedicated processors (e.g., GPU: Graphics Processing Unit, ASIC: Application Integrated Circuit, FPGA: Field Programmable Gate Array, and programmable logic device).

In the embodiment above, the term "processor" is broad enough to encompass one processor or plural processors in collaboration which are located physically apart from each other but may work cooperatively. The order of operations of the processor is not limited to one described in the embodiment above, and may be changed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet transport device comprising a processor configured to change lifting control for lifting sheets on a tray, which are to be floated up and handed over, from normal state control to small-quantity state control in a case where it is detected that a remaining number of sheets on the tray is small, wherein the processor lifts the sheets by a small-quantity state lifting amount, which is larger than a lifting amount during the normal state control, in a case where it is detected that the remaining number of sheets has decreased by a predetermined number during the small-quantity state control, and the processor executes a lifting amount adjusting processing in a case where the tray is at a position higher by a predetermined amount than a reference height for detecting that the number of sheets is small before start of transport of the sheets from the tray, during the lifting amount adjusting processing, the processor lifts the sheets by adjusting a lifting amount by which the tray is lifted based on a relative difference value of a current height of the tray with respect to the reference height, wherein the processor subtracts the reference height from the current height of the tray to obtain an excess amount and subtracts the excess amount from the small-quantity state lifting amount to obtain a subtracted amount, and the processor set the subtracted amount as the lifting amount by which the tray is lifted.

2. The sheet transport device according to claim 1, wherein the processor detects that the remaining number of sheets is small and that the remaining number of sheets has decreased by the predetermined number by different methods.

3. The sheet transport device according to claim 2, wherein the processor detects that the remaining number of sheets has decreased by the predetermined number on a basis of the number of sheets transported from the tray after the change to the small-quantity state control.

4. The sheet transport device according to claim 3, wherein the number of sheets used for the detection is larger in a case where a thickness of the sheets is small than in a case where the thickness of the sheets is large.

5. The sheet transport device according to claim 4, wherein during the small-quantity state control, the processor lifts the sheets by controlling an air blow amount for floating up the sheets.

6. The sheet transport device according to claim 3, wherein during the small-quantity state control, the processor lifts the sheets by controlling an air blow amount for floating up the sheets.

7. The sheet transport device according to claim 2, wherein during the small-quantity state control, the processor detects that the remaining number of sheets has decreased by the predetermined number on a basis of a lifting amount by which the tray is lifted in accordance with a height of the sheets on the tray.

8. The sheet transport device according to claim 7, wherein during the small-quantity state control, the processor lifts the sheets by controlling an air blow amount for floating up the sheets.

9. The sheet transport device according to claim 2, wherein during the small-quantity state control, the processor lifts the sheets by controlling an air blow amount for floating up the sheets.

10. The sheet transport device according to claim 1, wherein during the small-quantity state control, the processor lifts the sheets by controlling an air blow amount for floating up the sheets.

11. The sheet transport device according to claim 1, wherein during the small-quantity state control, the processor makes the lifting amount by which the tray is lifted larger in a case where a thickness of the sheets is large than in a case where the thickness of the sheets is small.

12. The sheet transport device according to claim 1, wherein during the small-quantity state control, the processor makes the lifting amount by which the tray is lifted larger in a case where a width dimension of the sheets is large than in a case where the width dimension of the sheets is small.

13. The sheet transport device according to claim 1, wherein during the small-quantity state control, the processor makes the lifting amount by which the tray is lifted larger in a case where a length dimension of the sheets is large than in a case where the length dimension of the sheets is small.

14. A non-transitory computer readable medium storing a program causing a computer to execute a process comprising:

changing lifting control for lifting sheets on a tray, which are to be floated up and handed over, from normal state control to small-quantity state control in a case where it is detected that a remaining number of sheets on the tray is small, wherein the sheets are lifted by a small-quantity state lifting amount, which is larger than a lifting amount during the normal state control, in a case where it is detected that the remaining number of sheets has decreased by a predetermined number during the small-quantity state control, and a lifting amount adjusting processing is executed in a case where the tray is at a position higher by a predetermined amount than a reference height for detecting that the number of sheets is small before start of transport of the sheets from the tray, during the lifting amount adjusting processing, the sheets are lifted by adjusting a lifting amount by which the tray is lifted based on a relative difference value of a current height of the tray with respect to the reference height, wherein the reference height is subtracted from the current height of the tray to obtain an excess amount and subtracts the excess amount from the small-quantity state lifting amount to obtain a subtracted amount, and the subtracted amount is set as the lifting amount by which the tray is lifted.

* * * * *